US006166360A

United States Patent [19]

Ruffini, Sr. et al.

[11] Patent Number: 6,166,360

[45] Date of Patent: Dec. 26, 2000

[54] HEAT TREATING OF METALLURGIC ARTICLE WITH VARYING ASPECT RATIOS

[75] Inventors: Robert S. Ruffini, Sr., Beverly Hills; Valentin Nemkov, Auburn Hills, both of Mich.

[73] Assignee: Fluxtrol Manufacturing, Inc., Auburn Hills, Mich.

[21] Appl. No.: 09/417,967

[22] Filed: Oct. 13, 1999

[51] Int. Cl.[7] ..... H05B 6/10

[52] U.S. Cl. ..... 219/639; 219/601; 219/635; 219/656; 148/566; 148/572

[58] Field of Search ..... 219/601, 602, 219/635, 637, 639, 646, 656; 148/566, 567, 569, 572, 573; 266/128, 129

[56] References Cited

U.S. PATENT DOCUMENTS

| | | | |
|---|---|---|---|
| 2,163,993 | 6/1939 | Dufour et al. | 219/601 |
| 3,708,645 | 1/1973 | Osborn, Jr. | 219/601 |
| 3,715,556 | 2/1973 | Balzer et al. | 219/601 |
| 5,055,648 | 10/1991 | Iceland et al. | 219/601 |

*Primary Examiner*—Philip H. Leung
*Attorney, Agent, or Firm*—Harness, Dickey & Pierce, P.L.C.

[57] ABSTRACT

This invention provides methods for rapidly heating a metal part of varying thickness. In general, the invention provides methods comprising heating the thicker section(s) of the part by induction heating and the thinner section(s) by resistance heating. Induction and resistance heating both quickly heat metals and because each is easily controlled individually, the part can be uniformly heated for hardening and tempering.

22 Claims, 2 Drawing Sheets

HEAT TREATING OF METALLURGIC ARTICLE WITH VARYING ASPECT RATIOS

BACKGROUND OF THE INVENTION

This invention generally relates to a method of uniformly heating a part of varying thickness for hot forming and heat treatments such as hardening and tempering. More specifically, this invention relates to a method comprising both induction and conductance heating to uniformly or selectively heat a metal part having varying aspect ratios.

Metal parts of all sizes and shapes are heat treated in order to harden, strengthen, and improve properties of the parts. Heat treating to harden a metal requires heating to above a critical temperature range followed by rapid cooling, typically in oil, water, or polymer solutions. This is followed by tempering, a lower temperature reheating treatment which reduces the internal stress caused by a hardening treatment and modifies the microstructure of the metal if required.

Heat treating a metal results in changes to the microstructure of the metal. The resulting microstructure can either produce the desired hardness or can cause weaknesses in the metal. Time and temperature are critical elements in heat treating to assure that the correct microstructure is obtained. Rapid heating and cooling of the metal will produce the desired hardened metal, whereas slow heating and cooling can often result in metals that have weakened structures due to a less than optimal microstructure.

Two main methods currently used for heating metals for hardening and tempering are furnace heating and induction heating. In the former, the part to be heated is placed in a furnace and allowed to heat to the desired temperature.

This process is slow and the temperature of the metal is not easily controlled. If the part to be heated has varying aspect ratios along its dimension (i.e., varies in shape and thickness along its length), there will be undesirable differences in the rate of heating and also in temperature distribution throughout the part.

Induction heating is the heating of an electrical conducting material by eddy currents induced by a varying electromagnetic field. The metal part is placed in the center of an induction coil. As an alternating current flows through the coil, secondary currents (eddy currents) will be induced in the metal part. These eddy currents generate heat due to the metal resistivity. The advantages of induction heating over conventional processes such as furnace heating are the high speed of heating, localization of the heating, and the ease of controlling the heating to achieve the desired temperature. However, if the part to be treated varies in shape and thickness, it is difficult, or even impossible, to heat it uniformly.

Therefore, it would be desirable to have a method to uniformly heat metal parts having variable aspect ratios along the length of the part. It would be further desirable if such a method could rapidly heat the metal part. It would also be desirable if the temperature could be easily controlled during the heating process.

SUMMARY OF THE INVENTION

The present invention provides methods for rapidly heating a metal part having varying aspect ratios. In particular, methods are provided comprising heating the portions of the metal part having the larger cross-sectional areas of the part by induction heating and the portions having the smaller cross-sectional areas by conduction heating. The methods further comprise heating portions of the metal part having cross-sectional areas intermediate to the larger and smaller areas by a combination of both induction and conduction heating methods.

More specifically this invention provides a method for rapidly heating a metal part having a varying aspect ratio between a first portion having a first cross-sectional area and a second portion having a second cross-sectional area less than the first area. In general, the invention provides methods comprising heating the first portion of the part by induction heating and the second portion of the part by conduction heating. Induction and conduction heating of the part act cooperatively for providing consistent heating of the part throughout.

It is an object of the present invention to use the benefits of induction heating and conduction heating in combination to heat a metal article having a variable aspect ratio. Induction heating is effective on thicker areas and tapers off in effectiveness in thinner areas of the part, whereas conduction heating is more effective in thinner areas with effectiveness tapering off in thicker areas. Induction heating and conduction heating used in accordance with the teachings of the present invention can be effectively used to heat a variable aspect ratio part.

BRIEF DESCRIPTION OF THE DRAWINGS

The features and advantages of the method of the present invention will be more clearly understood from the following description taken in conjunction with the accompanying drawings in which.

DETAILED DESCRIPTION OF THE INVENTION

The present invention provides methods for rapidly heating a metal part having varying aspect ratios. In particular, methods are provided comprising heating the portions of the metal part having the larger cross-sectional areas of the part by induction heating and the portions having the smaller cross-sectional areas by conduction heating. The methods further comprise heating portions of the metal part having a cross-sectional area intermediate to the larger and smaller areas by a combination of both induction and conduction heating methods.

This invention also provides a method for rapidly heating a metal part 10 having varying aspect ratios. In general, the invention provides a method comprising heating a first portion 12 having a first cross-sectional area of the part by induction heating and a second portion 14 having a second cross-sectional area less than the first portion 12 by conduction heating.

Figure 1:
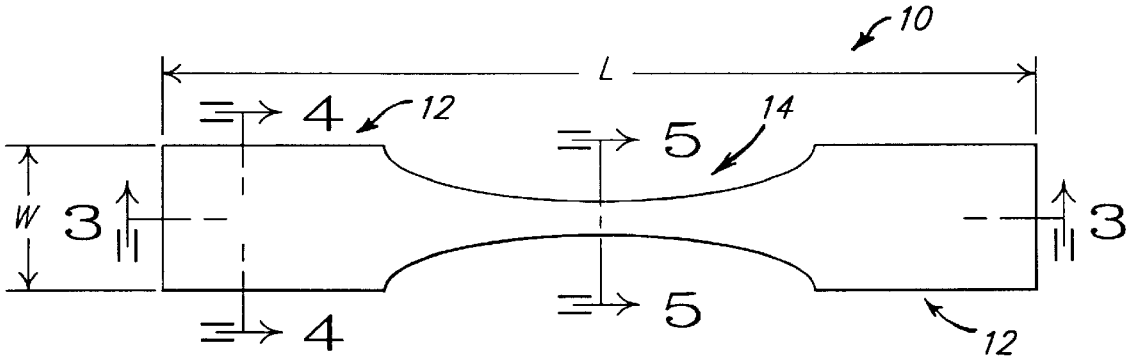
FIG. 1 is a top view of a part having variable aspect ratios.
Figure 3:
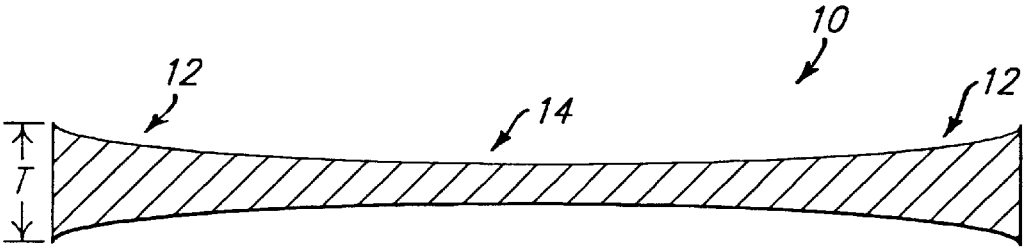
FIG. 3 is a sectional view of a part taken along line 3—3 of FIG. 1.
Figure 4:
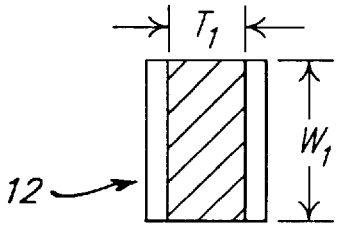
FIG. 4 is a sectional view taken along line 4—4 of FIG. 1.
Figure 5:
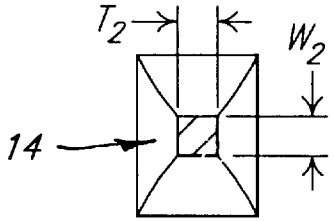
FIG. 5 is a sectional view taken along line 5—5 of FIG. 1.

Referring to the drawings, there is shown a part 10 which possess large end portions which then taper to the center along its length (L) and width (W) as shown in FIG. 1 and its thickness (T) as shown in FIG. 3. Thus, the aspect ratio of the part varies along the length such that it has a greater cross-sectional area at a first portion 12 (see FIG. 4, $W_1$,$T_1$) and progressively thinner moving toward a second portion 14 for forming a lesser cross-sectional area (see FIG. 5, $W_2$,$T_2$).

Figure 6:
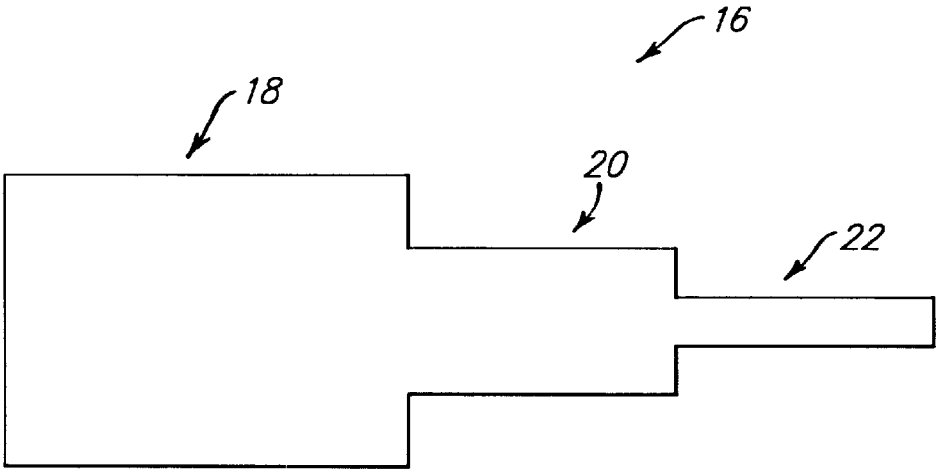
FIG. 6 is a view of an alternative part having varying aspect ratios.

While heating of a tapered part is shown, the subject process can be applied to any metal article, having either squared or rounded edges (cylindrical), which is subject to heating by conduction and induction, which has diverse cross-sectional areas. By way of non-limiting example, a part having the general shape of part 16, having multiple portions of varying aspect ratios, can also be treated using the methods of the present invention. Referring to the drawings, there is shown a part 16 which has three portions with different areas along its length as shown in FIG. 6. Applying the methods of the present invention, portion 18, having the greatest cross-sectional area, is heated by induction heating while portion 22, having the least cross-sectional area, is heated by conduction heating. Portion 20, having a cross-sectional area less than portion 18 but greater than portion 22 can be heated by a combination of induction and conduction heating to give uniform heating throughout part 16.

The process of the present invention is most advantageous when there are relatively large aspect ratios between thin areas and thicker areas of the part. Thus, differences in aspect ratios of generally from about 2 to 1 to about 100 to 1 are effective using the process of the subject invention. Typically, the process will be used in metal parts having aspect ratios of from about 3 to about 30, with preferred ratios being from about 4 to about 10.

As stated above, such parts do not readily lend themselves to conventional induction treating heat methods. This is mostly due to the fact that the thinner and thicker areas heat with different ratios and efficiency, thus causing disparities in heating along the part, which results in defects in metallurgical properties of the part and physical deformities due to warpage or the like. However, utilizing the process of the present invention, induction and conduction heating act cooperatively to evenly heat a part with varying aspect ratios.

Figure 2:
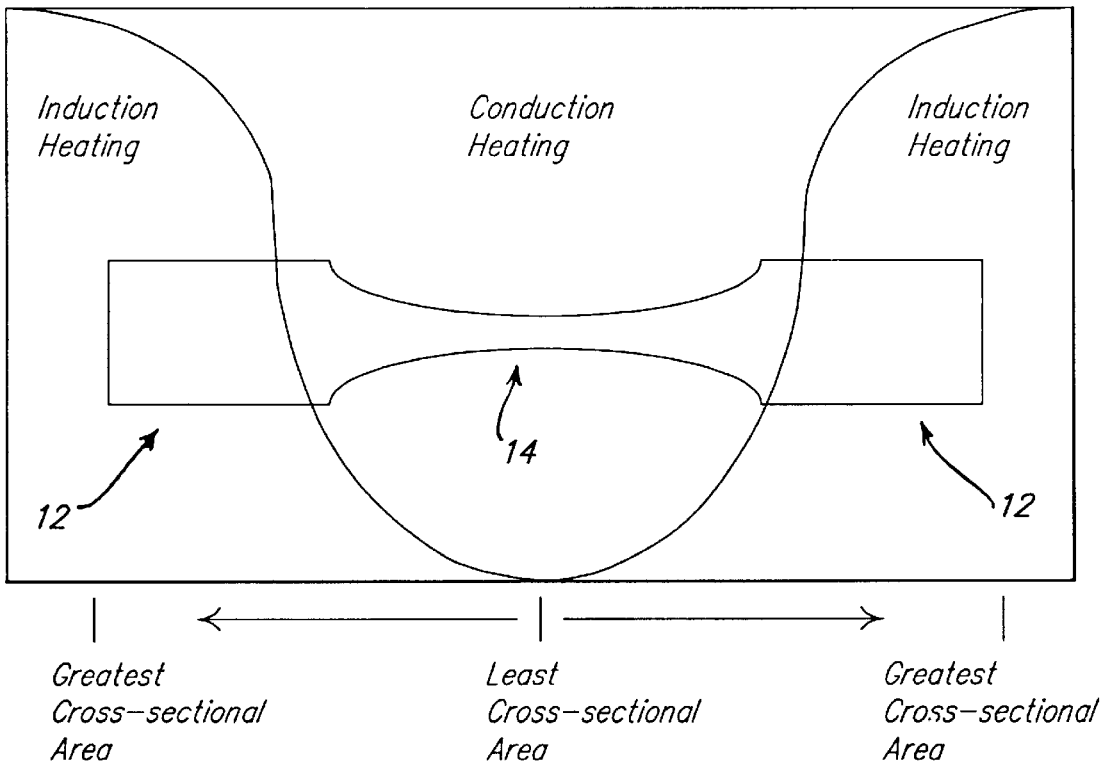
FIG. 2 is a schematic representation of the heat distribution due to induction heating and conduction heating.

In the present invention induction heating and conduction heating interactively act to heat the article to the desired temperature as follows. Induction heating is most efficient when used in thicker areas of the part 12. Induction heating is less effective and controllable in the thinner center portion 14 of the part 10. On the other hand, conduction heating is more efficient and controllable at the relatively thinner center 14 of the part 10. To a certain extent the process is self-regulating in that as the thickness increases the amount of heat supplied by induction heating increases and the amount of heat supplied by conduction heating decreases. This is demonstrated schematically in FIG. 2.

In a preferred embodiment induction heating and conduction heating are used concurrently to heat the part 10. Thus, the part 10 is placed adjacent to at least a single induction coil which is configured to act on either selected areas or the entire part. Conduction electrodes are attached to the thinner section of the part 14. Of course, the necessary currents, frequencies and heat times will depend upon the particular part to be heated. Thereafter, the appropriate currents are applied for concurrently heating the part 10 via induction heating and conduction heating.

In one embodiment the part 10 is placed within induction coils such that only the thickest portions 12 are within close proximity to the coils and the thinner part 14 is outside the coils. In an alternate embodiment, the entire part is placed within an induction coil such that thickest portions 12 are in closer proximity to the induction core.

With respect to induction heating parameters, an alternating current flows through the coils, producing an induced secondary current in the metal part. The frequency of the power applied will determine the efficiency and rate at which the part is heated and the final temperature achieved. Preferably, the frequency will be generally between 1 kHz and 1.0 MHz, and typically between 1 kHz and 0.5 MHz. More preferably, the frequency will be between 100–500 kHz. It is known to those skilled in the art that the effective depth of heat penetration is greater for lower frequencies and higher-resistivity metals. For efficient heating, the frequency employed must be high enough so that the depth of current penetration is less than one-third the diameter or dimension of cross section of the material being heated. When the parts are small, it is necessary to use higher frequencies to efficiently heat the part. Likewise, higher frequencies must be used when it is necessary to concentrate the heat near the surface, as in surface hardening applications.

The thinner sections of the piece are heated mainly by direct conduction heating. The electrodes for conductive heating can be attached anywhere on the part because of the natural flow of current throughout the part. Preferably, electrodes are attached to the thinner sections of the part with one electrode at one end of the section and the other electrode at the opposite end. Alternatively, the electrodes can be placed at both ends of the entire part. Alternatively, the conductors could be adapted to the tooling of the individual part. For instance, the part may be clamped onto a suitable holding structure for the induction heat treating of parts. The structure includes suitable induction coils for heat treating and contacts for passing current through parts. Alternatively, other fixturing could be used for holding the part and providing proper contacts. Also, the part itself may have tabs extending therefrom for providing a place to electrically contact the part to be heated such as with alligator clamps or the like.

A current (direct or alternating) having a frequency either the same or different from the induction frequency is applied and the metal part acts as a resistor. As with induction heating, the metal's resistance to the flowing current generates heat. Therefore, the degree of heating for a given current is proportional to the electrical resistance of the metal part. As will be appreciated by one skilled in the art, the current used may be alternating or direct current, and must be selected to match the heating capacity of the part to allow the part to reach the targeted temperature range through induction and conduction at approximately the same time. The rate of heating of the metal part and the final temperature can be controlled by controlling the amount of current that is applied. Typically, the current is generally in the range of 10 amps to 20 kilo amps, and more preferably, from 100 to 130 amps.

After heating the piece to the desired temperature for the desired amount of time, the piece is cooled by methods commonly used in metal heat treating. Such methods can be, but are not limited to, immersion into a cooling liquid such as water or brine, spraying with a mist of a cooling liquid, or allowing to air cool to the desired temperature.

Although particular embodiments of the present invention have been shown and described, it will be obvious to those skilled in the art that various changes and modifications may be made without departing from the spirit and scope of the present invention.

We claim:

1. A method for heating a metal article having at least a first portion having a first cross-sectional area and a second portion having a second cross-sectional area less than the first, comprising:

applying induction heating to at least said first portion; and selectively applying conduction heating directly to said second portion.

2. The method of claim 1 wherein said metal article includes a length and tapers between said first portion and said second portion along said length.

3. The method of claim 2 wherein the variation in cross-sectional area between said first portion and said second portion is because of a variation in the thickness of the article.

4. The method of claim 2 wherein the variation in cross-sectional area between said first portion and said second portion is because of a variation in width of the article.

5. The method of claim 2 wherein the variation in cross-sectional area between said first portion and said second portion is because of a variation in radius of the article.

6. The method of claim 2 wherein the variation in cross-sectional area from said first portion to said second portion is because of a variation in the group selected of thickness, width, radius and combinations thereof.

7. The method of claim 1 further comprising a third portion having a third cross-sectional area less than the first portion but greater than the second portion.

8. The method of claim 7 wherein the third portion is heated by applying a combination of induction and conduction heating.

9. A method for rapidly heating an elongated metal article to a uniform temperature comprising:

(a) providing an elongated part which has a first portion including a first thickness and width and tapering to a second portion having a second thickness and width less than the thickness and width of the first portion;

(b) placing the first portion of said piece adjacent an induction coil such that the first portion of said piece is selectively heated by induction heating; and (c) attaching electrodes to the second portion of said piece such that the second portion of said piece is selectively heated by conduction heating.

10. The method of claim 9 wherein the induction heating is at a frequency of from about 1 kHz to about 1.0 MHz.

11. The method of claim 9 wherein the induction heating is at a frequency of from about 1 MHz to about 0.5 kHz.

12. The method of claim 9 wherein the conduction heating is at a current of from about 10 amps to about 20 kilo amps.

13. The method of claim 9 wherein the conduction heating is at a current of from about 100 to 130 amps.

14. A method of heat treating a part having a varying aspect ratio comprising the steps of:

providing a metal part for heat treating said part, including at least a first portion having a first cross-sectional area and tapering into a second portion having a cross-sectional area less than the first; and selectively applying a conductive heating current directly to said second portion while concurrently heating the entire part by induction heating.

15. The method of claim 14 wherein said part has a length, width and a thickness and said part is tapered along said width.

16. The method of claim 15 wherein induction heating is accomplished at a frequency of from about 100 kHz to about 500 kHz and conduction current used is from about 100 amps to about 130 amps.

17. The method of claim 14 wherein said part has a length, width, and thickness and said part is tapered along said thickness.

18. The method of claim 17 wherein induction heating is accomplished at a frequency of from about 100 kHz to about 500 kHz and conduction current used is from about 100 amps to about 130 amps.

19. The method of claim 14 wherein said part has a length, width and thickness and said first and second dimensions are along the width and thickness.

20. The method of claim 19 wherein induction heating is accomplished at a frequency of from about 100 kHz to about 500 kHz and conduction current used is from about 100 amps to about 130 amps.

21. The method of claim 14 wherein said part is thicker in its width and thickness in a central portion and is thinner in its width and thickness at an end portion.

22. The method of claim 21 wherein induction heating is accomplished at a frequency of from about 100 kHz to about 500 kHz and conduction current used is from about 100 amps to about 130 amps.

* * * * *

UNITED STATES PATENT AND TRADEMARK OFFICE

CERTIFICATE OF CORRECTION

PATENT NO. : 6,166,360
DATED : December 26, 2000
INVENTOR(S) : Robert S. Ruffini, Sr. and Valentin Nemkov It is certified that error appears in the above-identified patent and that said Letters Patent is hereby corrected as shown below:

Column 6, claim 11,
Line 4, "1 MHz to about 0.5 kHz" should be -- 1 kHz to about 0.5 MHz --

Signed and Sealed this

Second Day of October, 2001

*Attest:*

Nicholas P. Godici

NICHOLAS P. GODICI
*Acting Director of the United States Patent and Trademark Office*

*Attesting Officer*